US006657600B2

(12) United States Patent
Thudor et al.

(10) Patent No.: US 6,657,600 B2
(45) Date of Patent: Dec. 2, 2003

(54) DEVICE FOR THE RECEPTION AND/OR THE TRANSMISSION OF ELECTROMAGNETIC SIGNALS WITH RADIATION DIVERSITY

(75) Inventors: Franck Thudor, Rennes (FR); Ali Louzir, Rennes (FR); Françoise Le Bolzer, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 10/166,845

(22) Filed: Jun. 11, 2002

(65) Prior Publication Data

US 2003/0020664 A1 Jan. 30, 2003

(30) Foreign Application Priority Data

Jun. 15, 2001 (FR) ..... 01 07866

(51) Int. Cl.[7] ..... H01Q 21/00
(52) U.S. Cl. ..... 343/770; 343/700 MS
(58) Field of Search ..... 343/700 MS, 767, 343/770

(56) References Cited

U.S. PATENT DOCUMENTS 5,400,042 A 3/1995 Tulintseff ..... 343/727
5,557,291 A * 9/1996 Chu et al. ..... 343/725
5,841,405 A * 11/1998 Lee et al. ..... 343/795
6,246,377 B1 * 6/2001 Aiello et al. ..... 343/770
6,292,153 B1 * 9/2001 Aiello et al. ..... 343/767
6,373,349 B2 * 4/2002 Gilbert ..... 333/126
6,525,696 B2 * 2/2003 Powell et al. ..... 343/770

FOREIGN PATENT DOCUMENTS

EP 0685901 A2 5/1995 ..... H01Q/21/20
FR 2785476 A1 11/1998 ..... H04B/7/02

* cited by examiner

*Primary Examiner*—Tan Ho
(74) *Attorney, Agent, or Firm*—Joseph S. Tripoli; Brian J. Cromarty

(57) ABSTRACT

The present invention relates to a device for the reception and/or the transmission of electromagnetic signals comprising at least two means of reception and/or of transmission of electromagnetic signals of the slot-fed antenna (11*a*, 11*b*, 11*c*, 11*d*) type and means of connection for connecting at least one of the said means of reception and/or of transmission to means of utilization of the multibeam signals, in which the means of connection consist of two feed lines (12, 13) connected by a connection element to the utilization means (P), the two lines being coupled electromagnetically with the slots of the slot-fed antennas, each line terminating in a switching element (14, 15) arranged in such a way as to simulate, as a function of a monitoring signal, an open circuit or a short circuit at the extremity of one of the lines and a short circuit or an open circuit at the extremity of the other line so as to obtain different radiation patterns.

9 Claims, 6 Drawing Sheets

DEVICE FOR THE RECEPTION AND/OR THE TRANSMISSION OF ELECTROMAGNETIC SIGNALS WITH RADIATION DIVERSITY

The present invention relates to a device for the reception and/or the transmission of electromagnetic signals which can be used in the field of wireless transmissions, in particular in the case of transmissions in an enclosed or semi-enclosed environment such as domestic environments, gymnasia, television studios or auditoria, etc.

BACKGROUND OF THE INVENTION

In the known systems for high-throughput wireless transmissions, the signals sent by the transmitter reach the receiver along a plurality of distinct routes. When they are combined at receiver level, the phase differences between the various rays which have travelled routes of different length give rise to an interference figure liable to cause fadeouts or a considerable degradation of the signal. Moreover, the location of the fadeouts changes over time as a function of the modifications of the surroundings, such as the presence of new objects or the passage of people. These fadeouts due to multipaths may engender considerable degradations both as regards the quality of the signal received and as regards the performance of the system.

To remedy the problem of fadeouts relating to multipaths, use is currently made of directional antennas which, through the spatial selectivity of their radiation patterns, make it possible to reduce the number of rays picked up by the receiver, thus attenuating the effect of the multipaths. In this case, several directional antennas associated with signal processing circuits are required to ensure spatial coverage of 360°. French Patent Application No. 98 13855 filed in the name of the applicant also proposes a compact multibeam antenna making it possible to increase the spectral efficiency of the array. However, for a number of items of domestic or portable equipment, these solutions remain bulky and expensive.

To combat fadeouts, the technique most often used is a technique using space diversity. As represented in FIG. 1, this technique consists among other things in using a pair of antennas with wide spatial coverage such as two antennas of the patch type (1, 2) which are associated with a switch 3. The two antennas are spaced apart by a length which must be greater than or equal to $\lambda O/2$ where $\lambda O$ is the wavelength corresponding to the operating frequency of the antenna. With this type of device, it can be shown that the probability of the two antennas being simultaneously in a fadeout is very small. The proof results from the description given in "Wireless Digital Communication", Dr Kamilo Feher—chapter 7—Diversity Techniques for Mobile-Wireless Radio Systems, in particular from FIG. 7.8, page 344. It can also be proven through a pure probability calculation with the assumption that the levels received by each patch are completely independent. It can be stated, in this case, that if p (1% for example) is the probability that the signal received by an antenna has a level lower than a detectability threshold, the probability that this level is below the threshold for the two antennas is $p^2$ (hence 0.01%). If the two signals are not perfectly uncorrelated, then $p_{div}$ is such that $0.01\% < p_{div} < 1\%$, where $p_{div}$ is the probability that the level received is lower than the detectability threshold in the case of diversity. Moreover, by virtue of the switch 3, it is possible to select the branch linked to the antenna exhibiting the highest level by examining the signal received by way of a monitoring circuit (not represented). The antenna switch 3 is connected to a switch 4 making it possible to operate the two patch antennas 1 or 2 in transmission mode when they are linked to the T×5 circuit or in reception mode when they are linked to the R×6 circuit.

SUMMARY OF THE INVENTION

The aim of the present invention is to propose an alternative solution to a conventional solution of the type described above, which applies to antennas of the slot-fed type and which makes it possible to obtain radiation diversity.

The aim of the present invention is also to propose a solution making it possible to preserve quasi-omnidirectional azimuthal coverage.

In consequence, the subject of the present invention is a device for the reception and/or the transmission of electromagnetic signals comprising at least two means of reception and/or of transmission of electromagnetic signals of the slot-fed antenna type and means of connection for connecting at least one of the said means of reception and/or of transmission to means of utilization of the multibeam signals, characterized in that the means of connection consist of two feed lines connected by a connection element to the utilization means, the two lines being coupled electromagnetically with the slots of the slot-fed antennas, each line terminating in a switching element arranged in such a way as to simulate, as a function of a monitoring signal, an open circuit or a short circuit at the extremity of one of the lines and a short circuit or an open circuit at the extremity of the other line so as to obtain different radiation patterns.

According to a preferred embodiment, the slot-fed antennas are antennas of the Vivaldi type regularly spaced around a central point. Moreover, the feed lines consist of microstrip lines or of coplanar lines.

In accordance with the present invention, the feed lines cross the slot-fed antennas in an open-circuit zone in respect of the slots.

According to another embodiment, the feed lines cross the slots of the slot-fed antennas in two distinct open-circuit planes of the slot. Moreover, the length of the first feed line between two slots of the slot-fed antennas is equal to $k\lambda l$ and the length of the second feed line between two slots of the slot-fed antennas is equal to $(k+0.5)\lambda l$ where $\lambda l$ is the wavelength guided in the line and k is a positive integer.

According to a preferred embodiment, the switching element consists of a diode. The connection element consists of a T element dimensioned to send the energy selectively to one or the other feed line. Hence, the length of the feed line between the slot of the slot-fed antenna and the T is equal to $I=\lambda l/2$ with n integer, and $\lambda l$ the wavelength guided in the line.

BRIEF DESCRIPTION OF THE DRAWINGS

Other characteristics and advantages of the present invention will become apparent on reading the description of various embodiments, this reading being undertaken with reference to the appended drawings in which.

DESCRIPTION OF PREFERRED EMBODIMENTS

To simplify the description, in the figures the same elements bear the same references.

Figure 2:
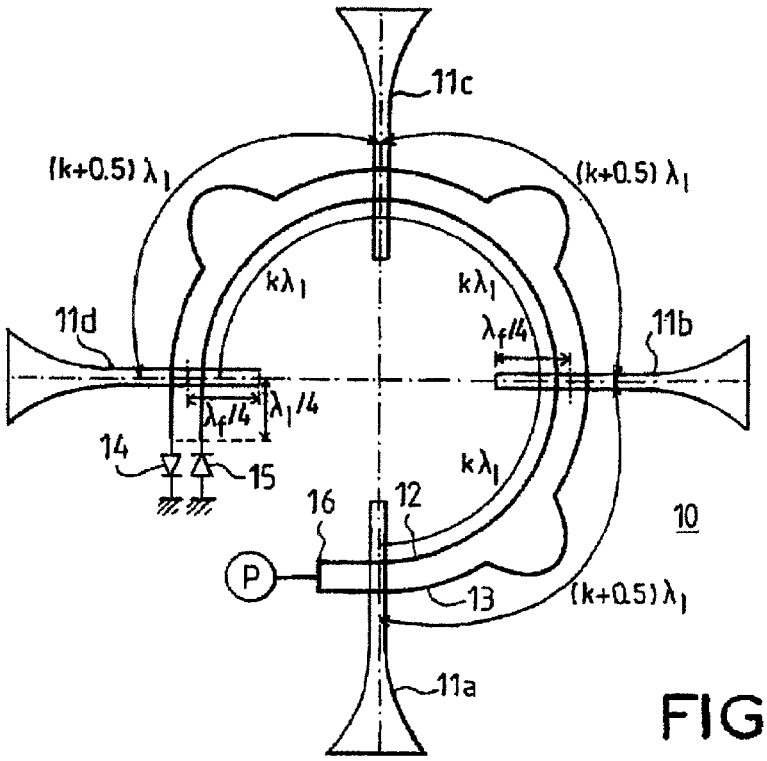
FIG. 2 diagrammatically represents a plan view from above of a first embodiment of a device in accordance with the present invention.

Represented in FIG. 2 is a first embodiment of a device for the reception and/or the transmission of electromagnetic signals comprising slot-fed antennas and exhibiting radiation diversity.

As represented in FIG. 2, the four antennas are antennas of the Vivaldi type 11*a*, 11*b*, 11*c*, 11*d* made on a common substrate 10 and positioned perpendicularly to one another around a central point. In a known manner, the structure of a Vivaldi antenna consists of a slot obtained by demetallizing the substrate, the slot flaring progressively outwards. This antenna structure being well known to the person skilled in the art, it will not be redescribed in greater detail within the framework of the invention.

In accordance with the present invention, the four Vivaldi antennas are excited by way of two feed lines 12, 13 made for example in microstrip technology. These two lines 12, 13 cross the slots of the four Vivaldi antennas and each terminate in a switching element 14, 15 arranged between the end of each line and the earth so that, as a function of the control voltage applied to the line, an open circuit or a short circuit is simulated at the extremity of one of the lines and a short circuit or an open circuit is simulated at the extremity of the other line.

As represented in FIG. 2, the switching element consists of a forward-mounted diode 14 arranged between the end of the line 13 and the earth and a reverse-mounted diode 15 arranged between the end of the feed line 12 and the earth. Moreover, the two feed lines 12, 13 are connected by way of a T circuit 16 to a common transmission/reception circuit symbolized by P. To obtain operation of the structure exhibiting the desired radiation diversity, the feed lines are dimensioned in the following manner, namely:

For the feed line 12, the length of line between two slots of two Vivaldi antennas such as 11*a*, 11*b* or 11*b*, 11*c* or 11*c*, 11*d* is equal to $k\lambda l$ where $\lambda l$ is the wavelength guided in the microstrip line 12 and the length between the last slot of the Vivaldi antenna 11*d* and the connection to the diode 15 is equal to $\lambda l/4$, $\lambda l$ being the wavelength guided in the microstrip line.

For the feed line 13, the length of line between two slots of Vivaldi antennas such as 11*a*, 11*b* or 11*b*, 11*c* or 11*c*, 11*d* is equal to $(k+0.5)\lambda l$ where $\lambda l$ is the wavelength guided in the microstrip line and the length of line between the slot of the last antenna 11*d* and the diode 14 is equal to $\lambda l/4$.

Moreover, as represented in FIG. 2, the feed lines 12, 13 cross the slots at a distance of nearly $\lambda f/4$ where $\lambda f$ is the wavelength guided in the slot. That is to say the feed lines cross the slots of the Vivaldi antennas in a short-circuit plane or open-circuit plane in respect of the line, as a function of the state of the diodes, and in an open-circuit zone in respect of the slot.

The principle of operation of the device of FIG. 2 as a function of the control voltage applied at P will now be explained:

If the control voltage is equal to +Vcc:

then the diode 15 is in the off state. This therefore results in an open circuit at the end of the feed line 12, thereby bringing back a short circuit into the plane of the slot feeding the antenna 11*d*. There is therefore electromagnetic coupling between the line 12 and the slot of the antenna 11*d*. Owing to the specific length of the stretches of the feed line 12 between each slot, an in-phase short circuit is established in the planes of the other three slots of the antennas 11*c*, 11*b*, 11*a*. In consequence, the four antennas 11*a*, 11*b*, 11*c*, 11*d* are coupled in-phase to the feed line 12.

Moreover, owing to its manner of arrangement, the diode 14 is on. There is therefore a short circuit at the extremity of the line 13, this bringing back an open circuit into the plane of the slot feeding the antenna 11*d*. Consequently, there is no coupling between the line 13 and the slot feeding the antenna 11*d*. Owing to the specific length of the stretches of the feed line 13 between each slot, an open circuit is therefore established in the planes of the other three slots of the antennas 11*c*, 11*b* and 11*a*. Hence, none of these antennas is coupled to the feed line 13.

If the control voltage fed in at P is equal to −Vcc:

the diode 15 is then on. There is therefore a short circuit at the extremity of the feed line 12, thereby bringing back an open circuit into the plane of the slot feeding the antenna 11*d*. Consequently, there is no electromagnetic coupling between the line 12 and the slot of the antenna 11*d*. The length of the stretches of the line 12 between each slot of the antennas 11*c*, 11*b* and 11*a* makes it possible to establish an open circuit in the planes of the other three slots. In this case, no antenna is coupled to the line 12.

The diode 14 is in an off state. There is therefore an open circuit at the extremity of the line 13 which brings back a short circuit into the plane of the slot feeding the antenna 11*d*. In consequence, there is electromagnetic coupling between the line 13 and the slot of the antenna 11*d*. Owing to the length of the stretches of line 13 between the slot of the antenna 11*d* and the slot feeding the antenna 11*c*, a short circuit in phase opposition is established in the plane of the slot feeding the antenna 11*c*. Likewise, the length of the stretch of the line 13 between the slot feeding the antenna 11*d* and the slot feeding the antenna 11*b* makes it possible to establish an in-phase short circuit in the plane of the slot feeding the antenna 11*b*. In the same way, a short circuit in phase opposition is established in the plane of the slot feeding the antenna 11*a*. In this case, the antennas 11*d*, 11*b* are coupled in-phase and the antennas 11*c*, 11*a* are coupled with a 180° phase shift.

Figure 3:
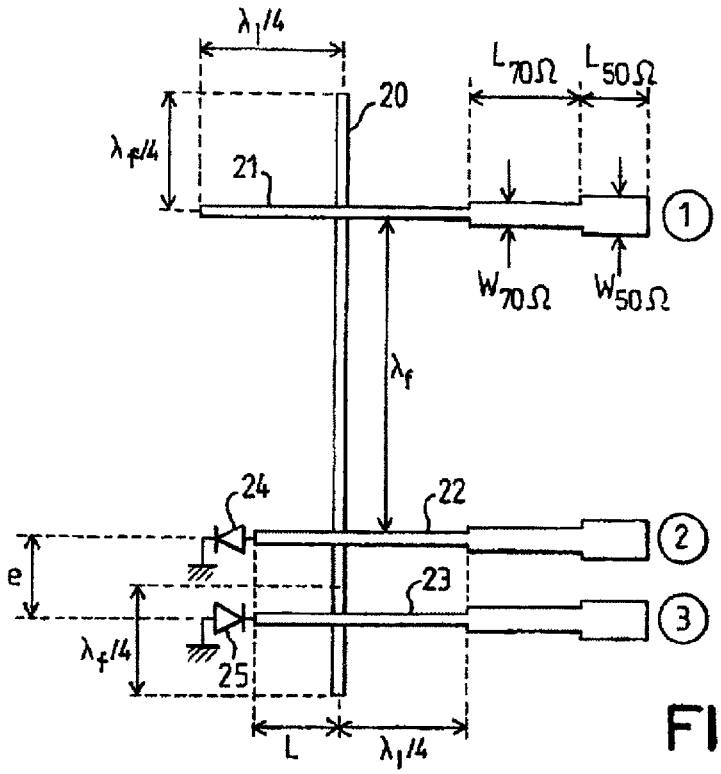
FIG. 3 is a diagrammatic view explaining the principle of operation of a line/slot device used to validate the simulation of a simple structure in accordance with the present invention.

The principle of operation of a device such as represented in FIG. 2 has been simulated using a simple structure such as that represented in FIG. 3. In this case, the antenna of the "slot antenna" type such as the Vivaldi antennas 11*a*, 11*b*, 11*c*, 11*d* is represented by a slot 20 coupled at a distance $\lambda f/4$ from the extremity of the slot to a line 21 linked to a port 1, this line 21 terminating in a line stub at 70 ohms and a line stub at 50 ohms for matching to the port. Moreover, on the other side of the line, at a distance λf from the line 21, where λf represents the wavelength guided in the slot, are positioned two other lines 22, 23 representing the feed lines 12, 13 of FIG. 2. The line 22 terminates in a forward-mounted diode 24 arranged between the end of the line 22 and the earth, while the line 23 terminates in a reverse-mounted diode 25 arranged between the end of the line 23 and the earth. The midplane between the two lines 22, 23 is a distance λf/4 from the other end of the slot 20. The two feed lines 22, 23 are coupled to feed ports 2, 3 by matching line stubs at 70 ohms and 50 ohms, just as for the line 21. The two lines 22, 23 are a sufficient distance apart for there to be no coupling between them, namely a distance e substantially equal to 5 times the width W of a line. More specifically, within the framework of the simulation, the values below were used for the various elements of FIG. 3.

λl/4=8.3 mm Wl=0.52 mm.

λf/4=10.1 mm Wf=0.4 mm.

$L_{70\ ohms}$=8 mm $W_{70\ ohms}$=1 mm $L_{50\ ohms}$=6 mm $W_{50\ ohms}$=1.85 mm e=2.6 mm L=6.05 mm.

Diode=HSMP 489B.

The coupling from the slot to one or the other of the lines as a function of the bias of the diodes is given by Table 1:

TABLE I

| Configuration | Control voltage | Diode at extremity of line 22 | Diode at extremity of line 23 | Coupling | No coupling |
|---|---|---|---|---|---|
| OC-SC | −Vcc | off (OC) | on (SC) | 1 to 2 | 1 to 3 |
| SC-OC | +Vcc | on (SC) | off (OC) | 1 to 3 | 1 to 2 |

Figure 4A:
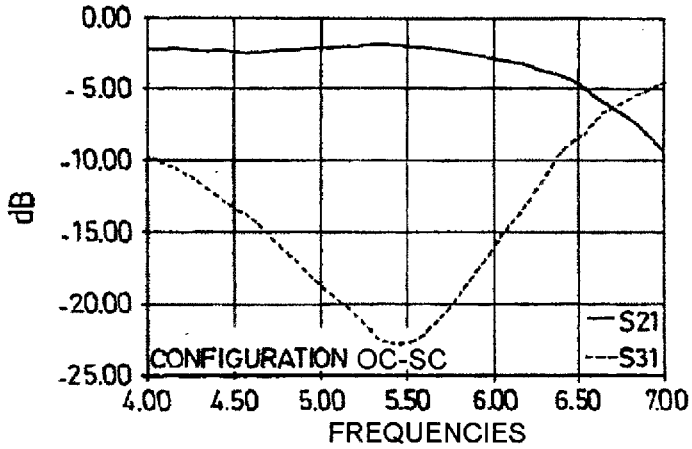
FIGS. 4*a* and 4*b* are curves representing the selective coupling in the two operating configurations of the circuit of FIG. 3.
Figure 4B:
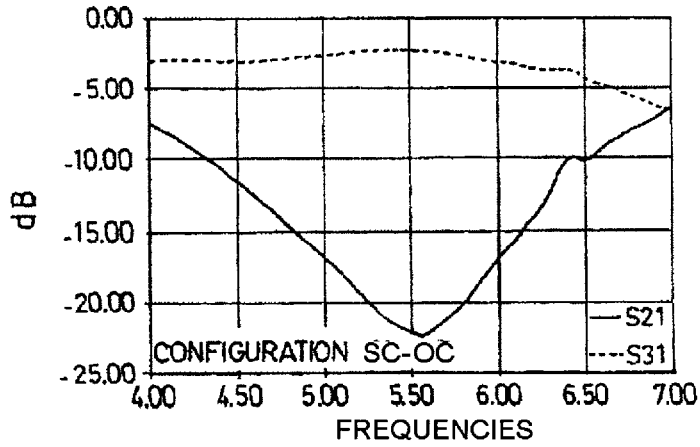

The results of the simulation are given by the curves of FIGS. 4*a* and 4*b* representing the selective coupling in the two configurations, namely the open circuit/short circuit configuration or the short circuit/open circuit configuration for the two lines.

According to the curves, it is appreciated that in the OC-SC configuration represented in FIG. 4*a*, the parameter S21 is high and exhibits a value of the order of (−1 to −2 dB) while the parameter S31 is low and exhibits a value of the order of −20 dB. There is therefore transmission from port 1 to port 2 and no transmission, namely isolation, between port 1 and port 3. For the SC-OC configuration represented in FIG. 4*b*, the reverse occurs. There is transmission from port 1 to port 3 since S31 exhibits a value of the order of −1 to −2 dB and no transmission from port 1 to port 2 since S21 exhibits a value of the order of −20 dB.

An embodiment of the circuit connecting the transmission/reception circuits symbolized by P to the two feed lines 12, 13 will now be described with reference to FIGS. 5 to 7.

Figure 5:
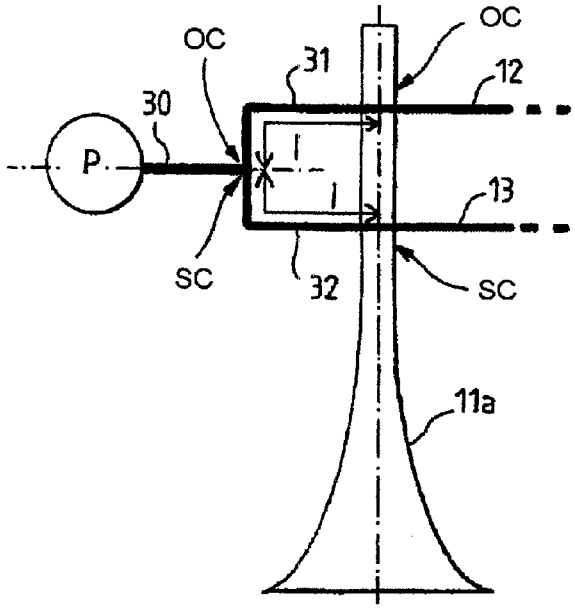
FIG. 5 is a diagrammatic plan view of the T circuit making it possible to feed the two lines used in the present invention.

As represented in FIG. 5, the circuit used is a T circuit making it possible to send the energy to one or the other of two feed lines 12, 13. The T circuit represented in FIG. 5 therefore comprises a branch 30 connected to the transmission/reception circuit P which is extended by the two branches 31 and 32 of a T, the branch 31 being linked to the feed line 12 while the branch 32 is linked to the feed line 13 in the embodiment of FIG. 2. In order for the energy to be sent correctly to one or the other of the two feed lines, the T circuit must be dimensioned as follows:

If the diode 15 is on while the diode 14 is off, the Vivaldi antennas are fed by the feed line 13.

As mentioned above, at each line/slot intersection, the line 12 exhibits an open circuit while the line 13 exhibits a short circuit. In order for the energy to be directed to the line 13 at the level of the T circuit, it is therefore necessary for:

the open circuit of line 12, brought back into the plane of the T, to become an open circuit, and for the short circuit of the line 13, brought back into the plane of the T, to become a short circuit.

To obtain operation of this type, it is necessary for the length of line l between the slot feeding the antenna 11*a* and the T circuit to satisfy the formula:

$L=n\lambda l/2$ with λl the wavelength guided in the feed line and n an integer.

This is represented clearly in FIG. 5.

Figure 6:
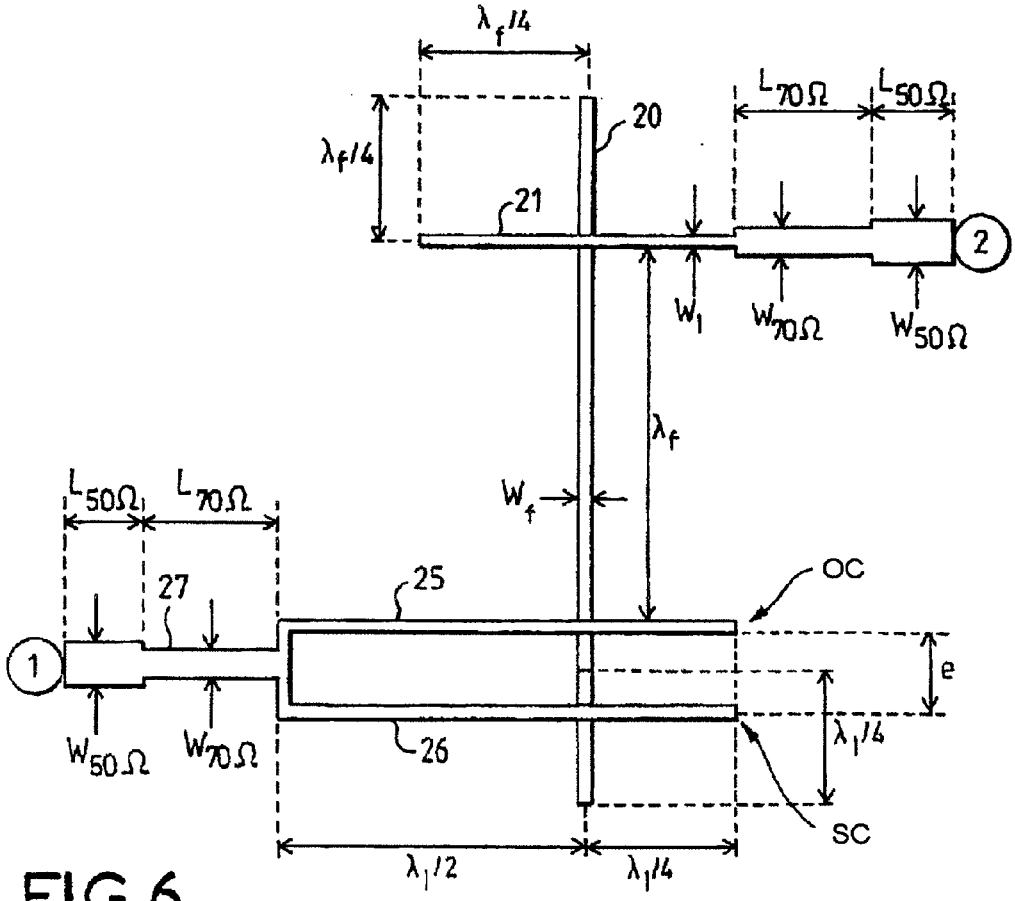
FIG. 6 is a diagrammatic representation of the device simulating the circuit in FIG. 5.

To prove the feasibility of such a T circuit, the circuit has been simulated using the IE3D software and by making the T circuit and the Vivaldi type antenna 11*a* in the manner represented in FIG. 6. In this case, the Vivaldi antenna 11*a* is represented by a slot 20 associated with a microstrip line 21 crossing the slot at a distance λf/4 from the end of the slot where λf is the wavelength guided in the slot and at a distance λl/4 from the end of the line 21 where λl is the wavelength guided in the microstrip line. The line 21 is extended by two lengths L 70 ohms and L 50 ohms of line allowing matching to the output port 1 on which the energy output is measured.

Moreover, as represented in FIG. 6, the T circuit of FIG. 5 consists of two stretches of microstrip line 25, 26 crossing the slot 20 at a length λf from the line 21 where λf represents the wavelength guided in the slot. The two lines 25 and 26 are together connected by a line 27 comprising two matching lines L 70 ohms and L 50 ohms to an input port receiving the energy of the transmission circuit.

As represented in FIG. 6, the two lines 25, 26 are placed in such a way that their midplane lies at an end λf/4 of the other end of the slot 20 and such that the distance between the input of the T circuit and the slot is equal to λl/2 and the end of the lines 25 and 26 lies at a distance λl/4 from the slot in such a way as to bring back an open circuit and a short circuit to the level of the line/slot crossover as explained above.

More practically, the dimensions below were used for the simulation.

λl/4=8.3 mm Wl=0.52 mm.

λf/4=10.1 mm Wf=0.4 mm.

$L_{70\ ohms}$=8 mm $W_{70\ ohms}$=1 mm $L_{50\ ohms}$=6 mm $W_{50\ ohms}$=1.85 mm e=2.6 mm.

Figure 7A:
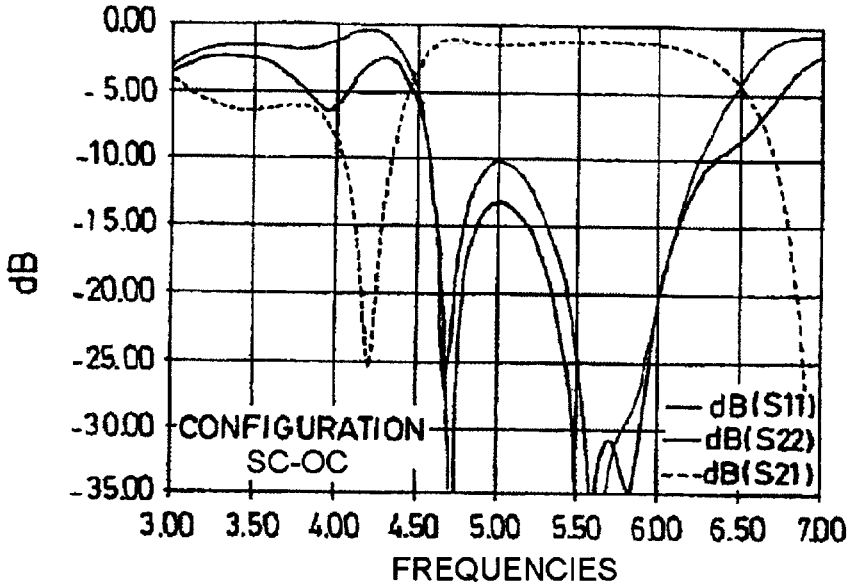
FIGS. 7*a* and 7*b* are curves giving the matching as a function of frequency in the case of the two operating configurations according to the present invention of the circuit of FIG. 6.
Figure 7B:
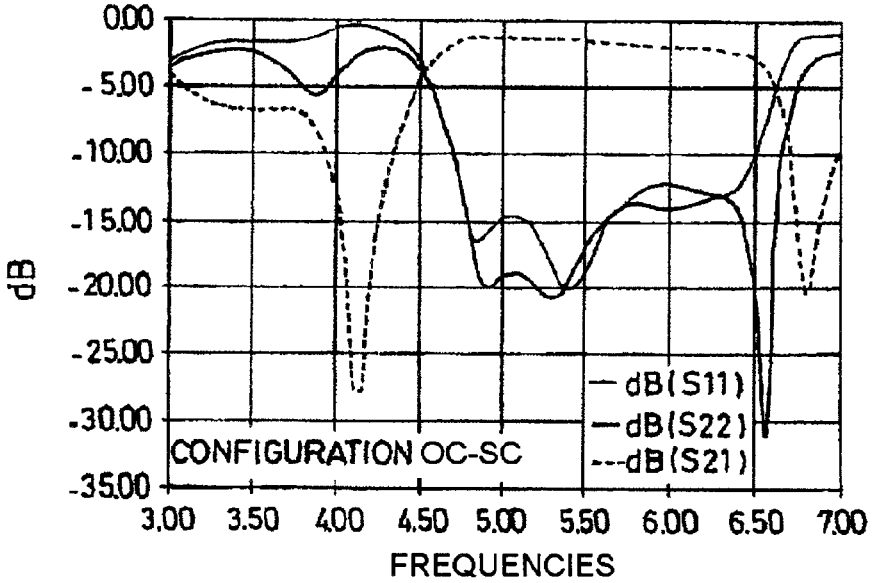

The results of the simulation are given in FIGS. 7*a* and 7*b* which represent the transmission and reflection coefficients in dB as a function of frequency, in the case of the two configurations short circuit/open circuit for FIG. 7*a*, and open circuit/short circuit for FIG. 7*b*. The results represented in the figures show that the passband is very wide with S11 and S22 less than −10 dB over at least 1.5 GHz and that the losses are small, namely less than −1.5 dB at 5.6 GHz.

Figure 8A:
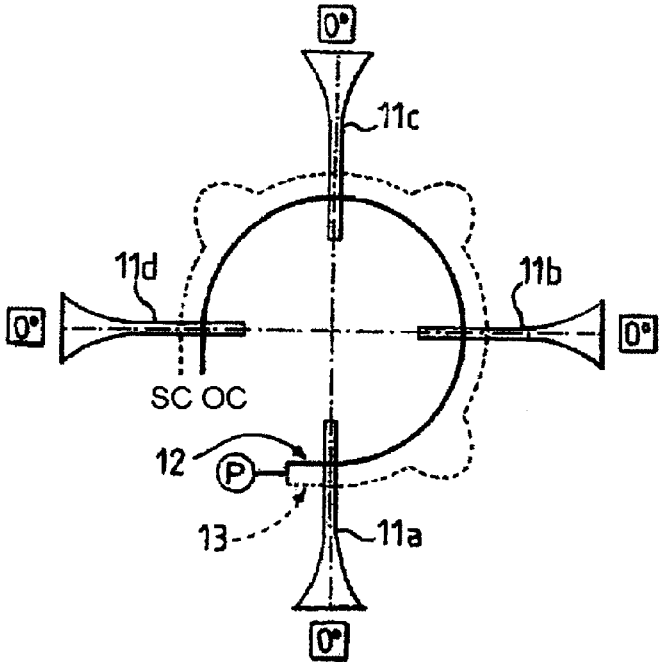
FIGS. 8*a* and 8*b* are diagrammatic views from above explaining the manner of operation of the device of FIG. 2.
Figure 8B:
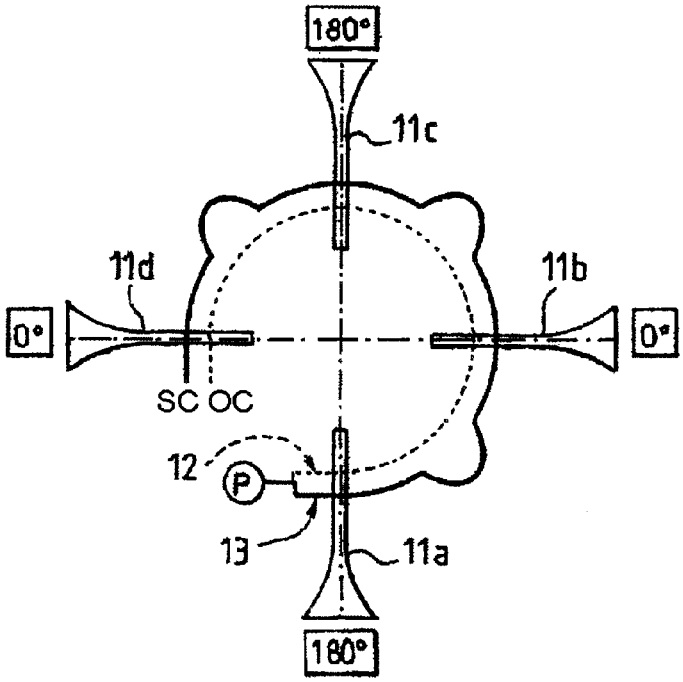
Figure 9:
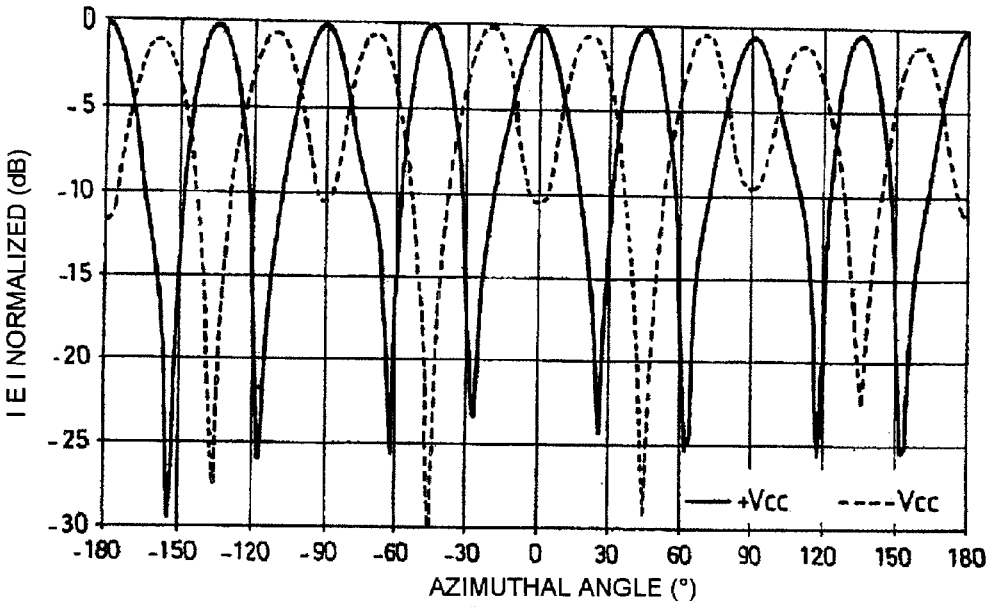
FIG. 9 represents the radiation pattern of the device of FIG. 2 as a function of the azimuthal angle depending on whether the control voltages are +VCC or −VCC.

The obtaining of radiation diversity with a device of the type of that represented in FIG. 2 will now be explained in more detail while referring to FIGS. 8*a*, 8*b* and to FIG. 9. With the system of FIG. 2, as explained above, depending on the control voltage applied, the Vivaldi type antennas 11*a*, 11*b*, 11*c*, 11*d* are in two configurations which differ in terms of phase. When the Vivaldi type antennas 11*a*, 11*b*, 11*c*, 11*d* are fed by way of the feed line 12, namely for a control voltage +Vcc, as represented in FIG. 8*a*, the four antennas 11*a*, 11*b*, 11*c*, 11*d* are in phase at 0°. When the control voltage applied is −Vcc, the feed line crossing the Vivaldi type antennas is the line 13, as represented in FIG. 8*b*. In this case, the antennas 11*a* and 11*c* are both in phase but in phase opposition with respect to the antennas 11*b* and 11*c*. Hence, the radiation patterns represented in FIG. 9 correspond to the configurations of FIGS. 8*a* and 8*b*. It is appreciated that the radiation maxima when the voltage applied is +Vcc are shifted by 22.5° when the voltage applied is −Vcc. Thus, depending on the control voltage applied, the lobes of the radiation pattern can be directed in the directions (−180°, −135°, −90°, −45°, 0°, 45°, 90°, 135°) or in the directions (−157.5°, −112.5°, −67.5°, −22.5°, 22.5°, 67.5°, 112.5°, 157.5°), this making it possible to maintain radiation diversity.

Figure 1:
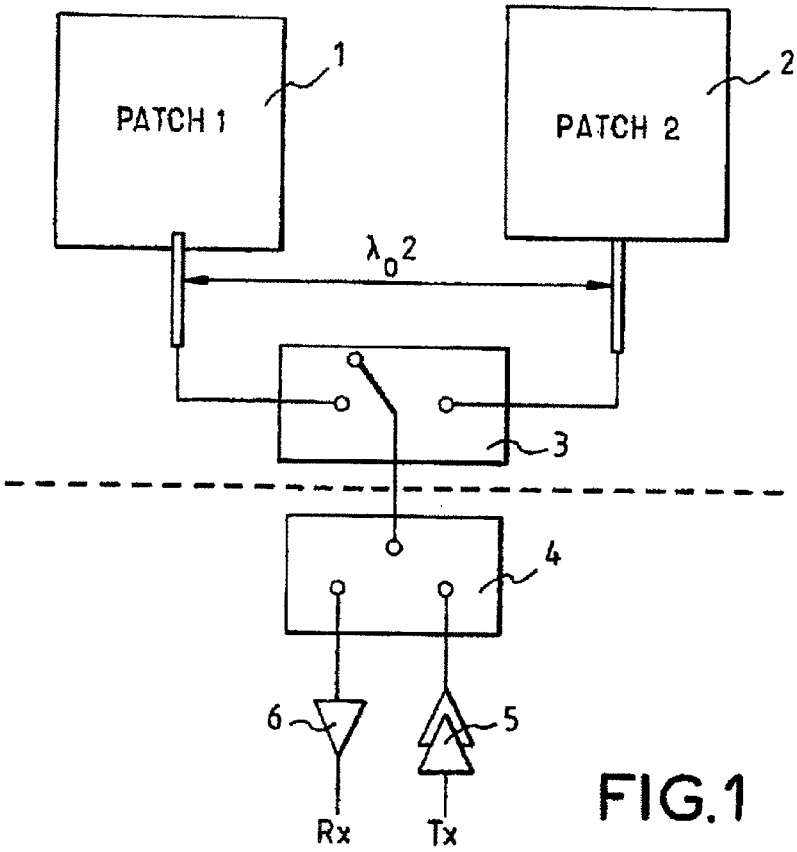
FIG.1 PRIOR ART
FIG. 1 already described is a diagrammatic plan view of a space diversity electromagnetic signals transmission/reception device according to the prior art.
Figure 10:
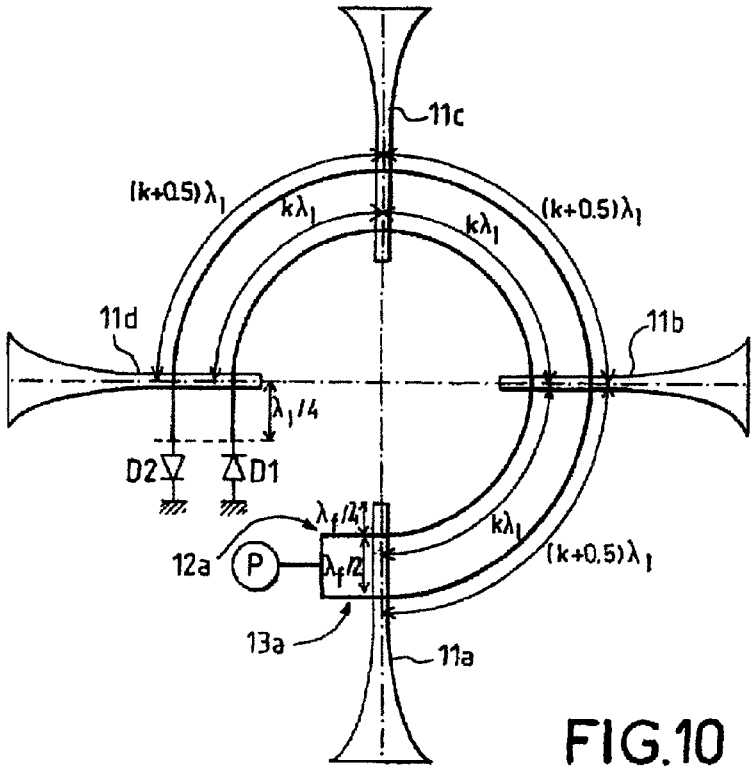
FIG. 10 is a diagrammatic plan view from above of another embodiment of a device in accordance with the present invention.

A new topology for the construction of the device for transmitting/receiving electromagnetic waves in accordance with the present invention will now be described with reference to FIG. 10. In this case, the Vivaldi type antennas 11*a*, 11*b*, 11*c*, 11*d* are fed by one or the other of the two feed lines 12, 13*a* as a function of the control voltage applied, just as for the embodiment of FIG. 2. The main difference relative to the structure represented in FIG. 1 is that the coupling between the two lines 12*a*, 13*a* and the slot of a Vivaldi antenna is effected in two distinct open-circuit planes of the slot, as represented clearly in FIG. 10. Specifically, the feed line 12*a* cuts the slot of the antennas 11*a*, 11*b*, 11*c*, 11*d* at a distance λf/4 from the end of the slot, while the feed line 13*a* cuts the slot of the said Vivaldi type antennas 11*a*, 11*b*, 11*c*, 11*d* at a distance λf/4+λf/2 from the end of the said slot. Hence, the feed lines are indeed in two distinct open-circuit planes, the length of the lines between two slots still satisfying the same equations, namely:

For the line 12*a*, the length between two slots of a Vivaldi type antenna 11*a*, 11*b* or 11*b*, 11*c* or 11*c*, 11*d* is equal to kλl where k is a positive integer and λl the wavelength guided in the feed line and, For the line 13*a*, the length of the line between two slots of the slot antennas such as 11*a*, 11*b* or 11*b*, 11*c* or 11*c*, 11*d* is equal to (k+0.5)λl where k is a positive integer and λl is the wavelength guided in the feed line. In this case also, the two lines 12*a* and 13*a* are connected to the transmission/reception circuit P by way of a T circuit of the same type as that described in FIG. 5. This new topology also makes it possible to obtain radiation pattern diversity as in the case of the topology represented with reference to FIG. 2.

It is obvious to the person skilled in the art that the embodiments described above may be modified in numerous ways without departing from the scope of the claims below.

What is claimed is:

1. Device for the reception and/or the transmission of electromagnetic signals comprising at least two means of reception and/or of transmission of electromagnetic signals of a slot-fed antenna type and means of connection for connecting at least one of the said means of reception and/or of transmission to means of utilization of the multibeam signals, wherein the means of connection consist of two feed lines connected by a connection element to the utilization means, the two lines being coupled electromagnetically with the set of slots of the slot-fed antennas, each line terminating in a switching element arranged in such a way as to simulate, as a function of a monitoring signal, an open circuit or a short circuit at the extremity of one of the lines and a short circuit or an open circuit at the extremity of the other line so as to obtain different radiation patterns.

2. Device according to claim 1, wherein the slot-fed antennas are antennas of the Vivaldi type regularly spaced around a central point.

3. Device according to claim 1 wherein the feed lines consist of microstrip lines or of coplanar lines.

4. Device according to claim 1, wherein the feed lines cross the slots of the slot-fed antennas in an open-circuit zone in respect of the slots.

5. Device according to claim 1, wherein the feed lines cross the slots of the slot-fed antennas in two distinct open-circuit planes of the slot.

6. Device according to claim 1, wherein a first feed line of the two feed lines between two slots of the slot-fed antennas has a length equal to $k\lambda_t$ and the second feed line of the two feed lines between two slots of the slot-fed antennas has a length equal to $(k+0.5)\lambda_t$ where $\lambda_t$ is the wavelength guided in the line and k a positive integer.

7. Device according to claim 1, wherein the switching element consists of a diode.

8. Device according to claim 1, wherein the connection element consists of a T element dimensioned to send the energy selectively to one or the other feed line.

9. Device according to claim 8, wherein the length of the feed line between the slot of the fed antenna and the T is equal to:

$$L=n\lambda l/2$$

with n integer, and $\lambda_l$ the wavelength guided in the line.

* * * * *